US008840379B2

(12) United States Patent
Wang

(10) Patent No.: US 8,840,379 B2
(45) Date of Patent: Sep. 23, 2014

(54) CEILING FAN

(75) Inventor: Cliff Wang, Taichung (TW)

(73) Assignee: Air Cool Industrial Co., Ltd., Taichung (TW)

( * ) Notice: Subject to any disclaimer, the term of this patent is extended or adjusted under 35 U.S.C. 154(b) by 286 days.

(21) Appl. No.: 13/592,743

(22) Filed: Aug. 23, 2012

(65) Prior Publication Data

US 2014/0056739 A1 Feb. 27, 2014

(51) Int. Cl.
*F04B 17/03* (2006.01)

(52) U.S. Cl.
USPC ..... 417/360; 417/423.7; 417/424.1; 416/5; 416/244 R; 310/91; 310/261.1

(58) Field of Classification Search
USPC ..... 417/360, 363, 423.6, 423.7, 424.1; 416/5, 210 R, 244 R; 310/91, 261.1
See application file for complete search history.

(56) References Cited

U.S. PATENT DOCUMENTS

| | | | | |
|---|---|---|---|---|
| 4,640,668 | A * | 2/1987 | Yang | 417/354 |
| 5,593,704 | A * | 1/1997 | Kahlen | 425/72.1 |
| 6,095,767 | A * | 8/2000 | Caughey | 417/411 |
| 6,102,663 | A * | 8/2000 | Wang | 416/244 R |
| 6,477,321 | B2 * | 11/2002 | Reiker | 392/364 |
| 2003/0095880 | A1 * | 5/2003 | Mehta | 417/423.13 |
| 2008/0317616 | A1 * | 12/2008 | Yu | 417/423.7 |

* cited by examiner

*Primary Examiner* — Charles Freay
(74) *Attorney, Agent, or Firm* — Wang Law Firm, Inc.; Li K. Wang; Stephen Hsu

(57) ABSTRACT

A ceiling fan includes an outer rotor motor having a rotor connected to a rotating disc and a stator connected with an inner tube. An outer tube is fitted around the inner tube, having one end connected with the rotating disc, and a plurality of elastic buffer pieces are positioned between the outer tube and the rotating disc. By so designing, when the rotor is rotated to actuate the rotating disc together with the outer tube to rotate, the elastic buffer pieces can absorb the vibration produced by operation of the outer rotor motor and also correct bias swinging of the outer tube through their elastic deformation to enable the outer tube to be rotated stably.

8 Claims, 5 Drawing Sheets

CEILING FAN

BACKGROUND OF THE INVENTION

1. Field of the Invention

This invention relates to a ceiling fan.

2. Description of the Prior Art

A conventional ceiling fan, as disclosed in a U.S. Patent Application Publication NO. 2008/0107527, includes a base 1 provided thereon with an outer rotor motor 2. An inner tube 3 is connected with the stator of the outer rotor motor 2, and an outer tube 4 is fitted around the outer side of the inner tube 3, having one end connected with the rotor of the outer rotor motor 2 and another end connected with a fan blade holder 5, with an outer casing 6 sheathing the outer sides of both the outer rotor motor 2 and the outer tube 4. Thus, when the conventional ceiling fan is started to operate, the rotor of the outer rotor motor 2 will actuate the outer tube 4 to rotate and the fan blade holder 5, with the outer tube 4 serving as a shaft center, will be driven to rotate synchronously.

However, since the inner tube 3 is generally locked and secured with the stator of the outer rotor motor 2; therefore, the inner tube 3 will be eccentrically combined with the stator because of influence of tolerance or the like and as a result, when the rotor of the outer rotor motor 2 drives the outer tube 4 to rotate, the outer tube 4 is easy to move bias and swing, letting a user have a misgiving about the safety in using the ceiling fan. In addition, the vibration produced by operation of the outer rotor motor 2 will also be directly transmitted to the outer tube 4 to make the outer tube 4 vibrate. In view of the situation, the conventional ceiling fan is provided with plural fixing cables 7 between the base 1 and the fan blade holder 5 for stabilizing the outer tube 4 and lowering the swinging extent of the outer tube 4, thus spoiling the external beauty of the ceiling fan.

SUMMARY OF THE INVENTION

The objective of this invention is to offer a ceiling fan that is able to eliminate the defect that the outer tube of a conventional ceiling fan is apt to produce vibration and bias swinging along with the operation of the motor, enabling the outer tube of the ceiling fan to rotate stably.

The ceiling fan in the present invention includes an outer rotor motor provided with a stator connected with a fixed shaft. The stator has its circumference annularly disposed with a rotor able to rotate with the stator acting as a center shaft. The ceiling fan of this invention is provided with a rotating disc connected to the rotor and bored with an insert hole at a location corresponding with the fixed shaft. The rotating disc is disposed with a plurality of elastic buffer pieces spaced apart around the insert hole, having a combination space formed between every adjacent two elastic buffer pieces. An inner tube has one end inserted through the insert hole of the rotating disc and secured with the fixed shaft, and an outer tube is fitted around the inner tube and has one end mounted thereon with a plurality of combination blocks to be respectively and correspondingly combined with the combination spaces of the rotating disc for connecting one end of the outer tube together with the rotating disc.

Thus, when the outer rotor motor is started to operate and have the rotor actuating the rotating disc together with the outer tube to rotate, the elastic buffer pieces positioned between the rotating disc and the outer tube can absorb the vibration produced by operation of the outer rotor motor. Moreover, even if the inner tube is obliged to be eccentrically combined with the fixed shaft due to influence of tolerance or the like, the elastic buffer pieces can also correct the state of eccentric combination via elastic deformation to enable the outer tube to be rotated stably. By so designing, the ceiling fan of this invention can get rid of the defect that the outer tube of the conventional veiling fan is liable to vibrate and swing bias when the motor is operated.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
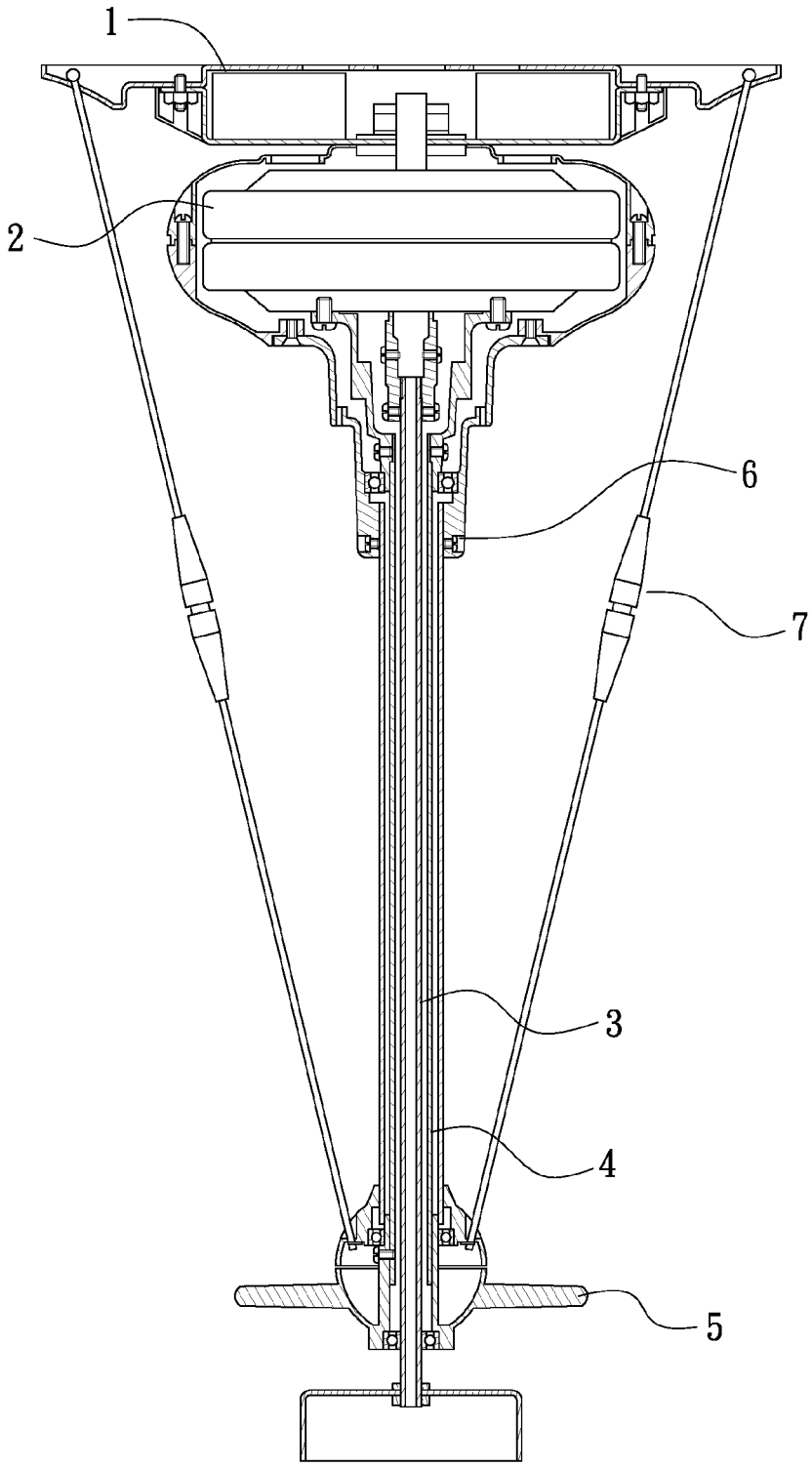
FIG. 1 PRIOR ART
FIG. 1 is a cross-sectional view of a conventional ceiling fan.
Figure 2:
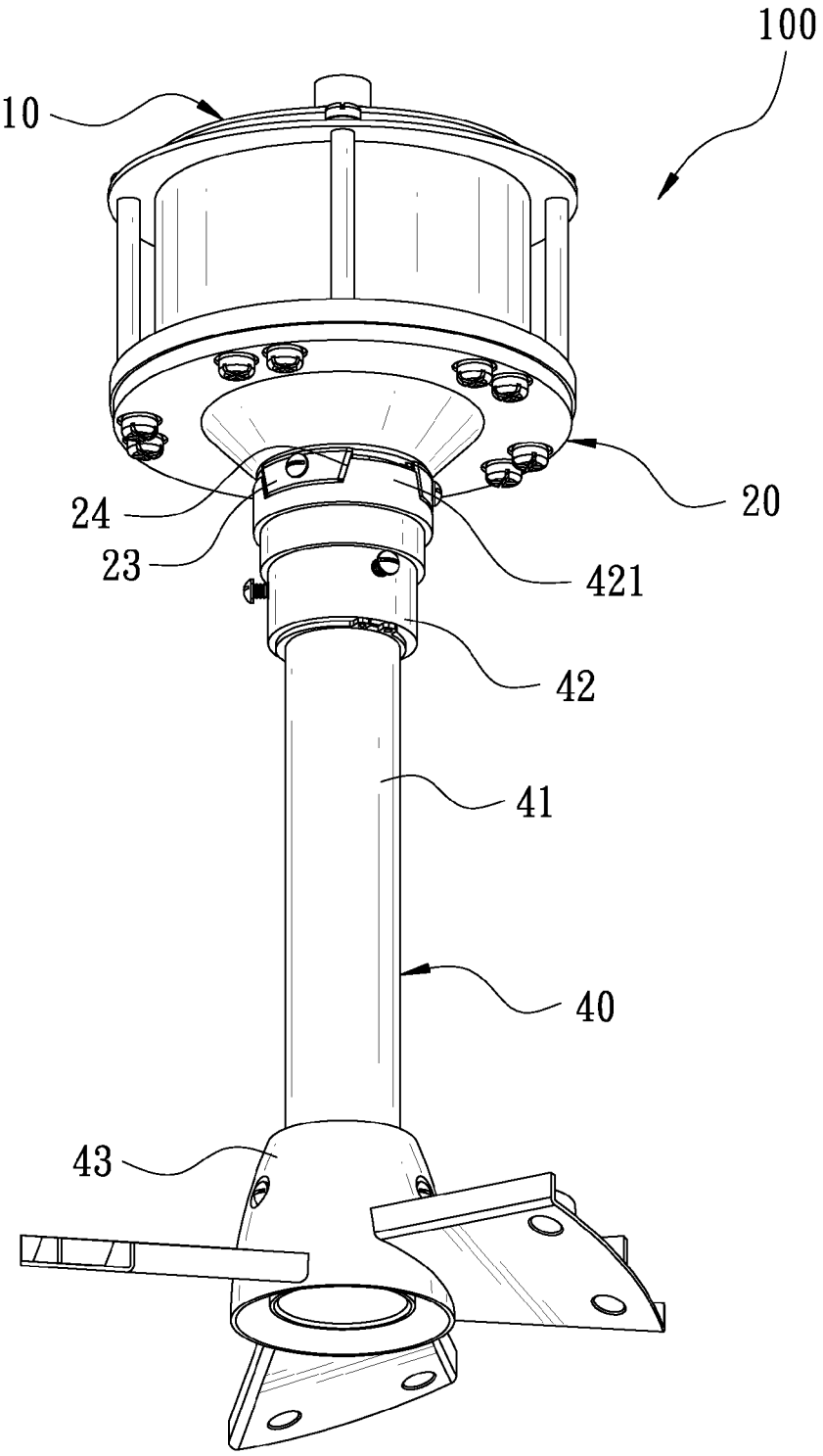
FIG. 2 is a perspective view of a ceiling fan in the present invention.
Figure 3:
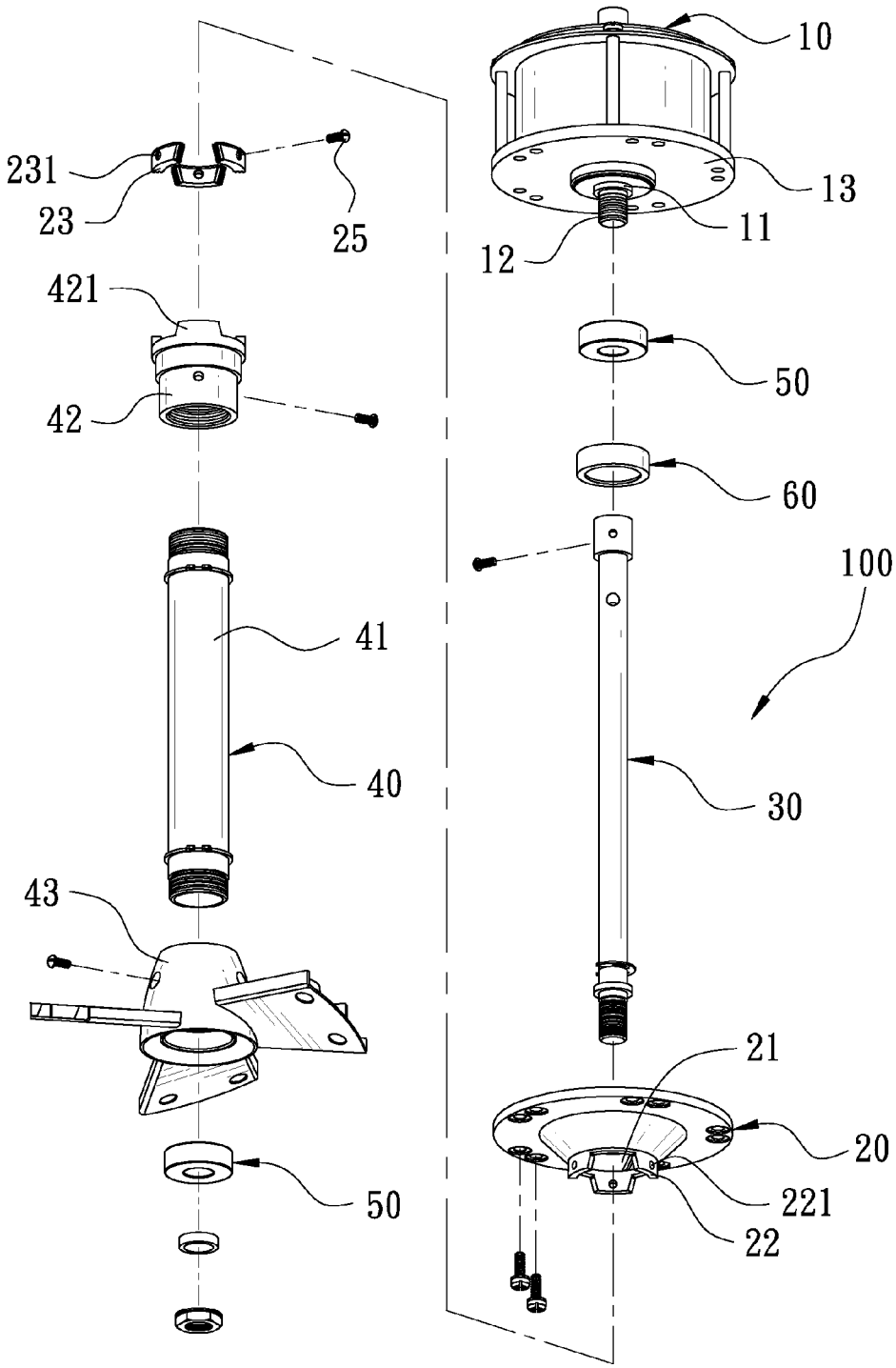
FIG. 3 is an exploded perspective view of the ceiling fan in the present invention.
Figure 4:
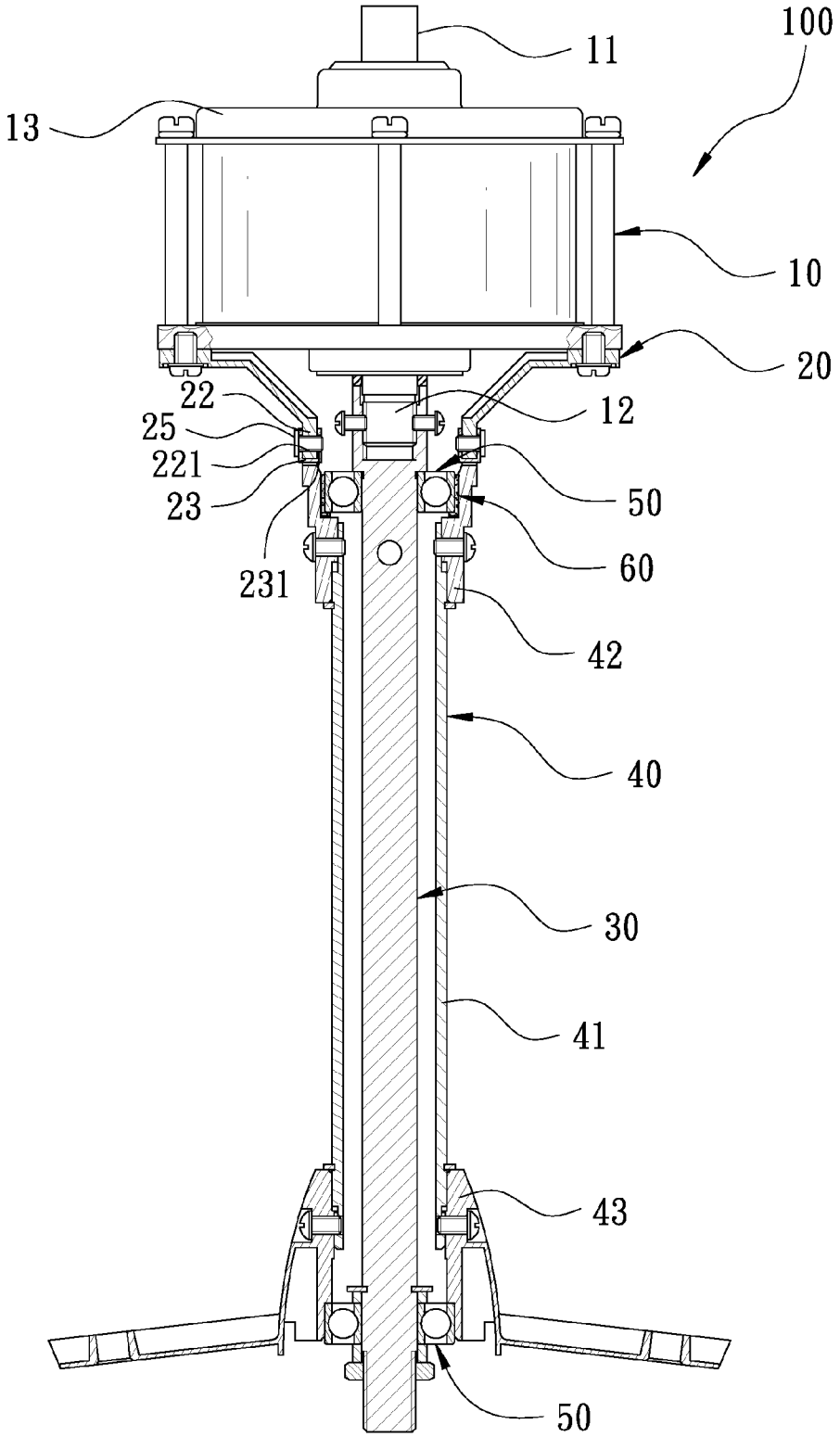
FIG. 4 is a cross-sectional view of the ceiling fan in the present invention.
Figure 5:
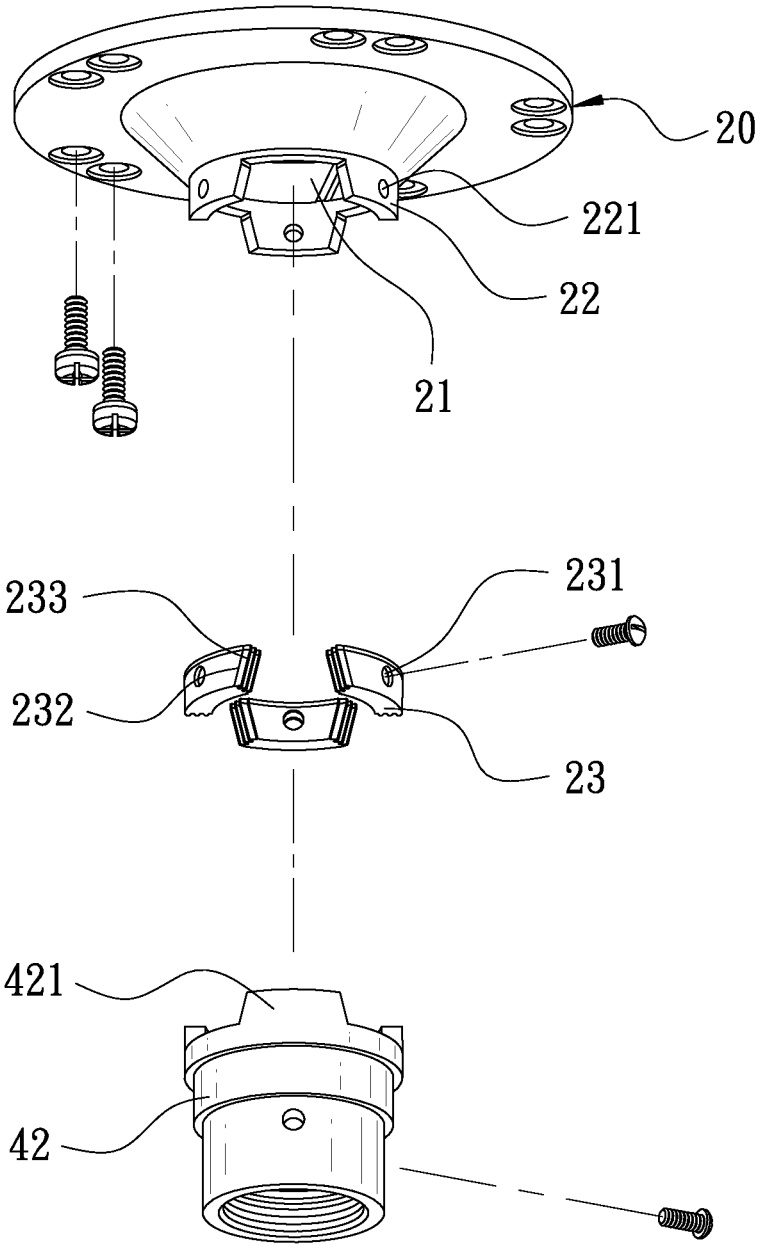
FIG. 5 is a partial magnified exploded perspective view of the ceiling fan in the present invention.

A preferred embodiment of a ceiling fan 100 in the present invention, as shown in FIGS. 2-5, includes an outer rotor motor 10, a rotating disc 20, an inner tube 30, an outer tube 40, a plurality of bearings 50 and a rubber ring 60 as main components combined together.

The outer rotor motor 10 has a stator 11 connected with a fixed shaft 12 and having its circumference annularly provided with a rotor 13 able to rotate with the stator 11 acting as a center shaft.

The rotating disc 20 connected to the rotor 13 is bored with an insert hole 21 at a location corresponding with the fixed shaft 12 and set thereon with a plurality of bulging blocks 22 spaced apart around the insert hole 21 and respectively having a first through hole 221. Further, the rotting disc 20 is annularly disposed with a plurality of elastic buffer pieces 23 spaced apart around the insert hole 21, having a combination space 24 formed between every adjacent two elastic buffer pieces 23. In this preferred embodiment, each elastic buffer piece 23 is a rubber sleeve fitted around the bulging block 22 of the rotating disc 20 and bored with a second through hole 231 at a location corresponding with the first through hole 221, with bolts respectively inserted and fixed in both the first and the second through holes 221 and 231 to secure the elastic buffer pieces 23 on the bulging blocks 22. Furthermore, each elastic buffer piece 23 has one side, facing the combination space 24, formed with a slant face 232, letting the combination space 24 formed into an inverted trapezoid shape, and another side, corresponding to the combination space 24, provided with plural V-shaped recesses 233 parallel to the slant face 232.

The inner tube 30 has a lower end inserted through the insert hole 21 of the rotating disc 20 and an upper end firmly connected with the fixed shaft 12.

The outer tube 40 to be fitted around the inner tube 30 has a lower end connected with the rotating disc 20. In this preferred embodiment, the outer tube 40 is formed with a tubular body 41 having an upper end connected with a connecting ring 42 mounted thereon with a plurality of combination blocks 421 at locations respectively corresponding to the combination spaces 24 of the rotating disc 20 for connecting the outer tube 40 together with the rotating disc 20. The tubular body 41 of the outer tube 40 has a lower end connected with a fan blade holder 43.

The bearings 50 are fitted between the inner tube 30 and the outer tube 40, having their outer circumferences respectively fitted thereon with a rubber bushing 60.

In assembly of the ceiling fan 100, referring to FIGS. 2-5, firstly, the rotating disc 20 is secured with the rotor 13 of the outer rotor motor 10 and then, the elastic buffer pieces 23 are respectively fitted around the bulging blocks 22 and fixed thereon by the bolts 25 that are respectively inserted and locked in the corresponding first through holes 221 of the bulging blocks 22 and the second through holes 231 of the elastic buffer pieces 23. Afterward, the inner tube 30 is inserted through the insert hole 21 of the rotating disc 20 and locked with the fixed shaft 12 of the outer rotor motor 10, and the outer tube 40 is fitted around the outer side of the inner tube 30, letting the combination blocks 421 respectively engaged in the corresponding combination spaces 24 to finish assembly of the ceiling fan 100.

Thus, when the outer rotor motor 10 is started to operate and have the rotor 13 actuating the rotating disc 20 together with the outer tube 40 to rotate, vibration produced by operation of the outer rotor motor 10 can be absorbed by the elastic buffer pieces 23 located between the rotating disc 20 and the outer tube 40. Moreover, even if the inner tube 30 is eccentrically connected with the fixed shaft 12 due to influence of tolerance, the situation of eccentric connection can also be corrected by the elastic buffer pieces 23 through their elastic deformation; hence the outer tube 40 can be rotated stably, able to eliminate the defect that the outer tube of the conventional ceiling fan is apt to produce vibration and partial swinging along with the operation of the motor.

One special feature of this invention is that the combination space 24 is formed into an inverted trapezoid shape while the combination block 421 is trapezoid-shaped. Therefore, when the combination block 421 is to be combined with the combination space 24, it is not only convenient for a user to have the combination block 421 aligned to and engaged in the combination space 24, but also able to insure that two sides of the combination block 421 can be closely combined with the corresponding elastic buffer piece 23 to enable the rotating disc 20 to surely drive the outer tube 40 to rotate.

Another special feature of the invention is that, after the two sides of the combination block 241 are closely combined with the corresponding elastic buffer piece 23, the V-shaped recesses 233 of the elastic buffer piece 23 still can offer a deformation space for the elastic buffer piece 23 to be deformed, able to elevate effects of shock absorption and deformation correction of the elastic buffer piece 23.

In addition, the rubber bushing 60 fitted around the outer circumference of the bearing 50 also has a function to carry out shock absorption and deformation correction, enabling the outer tube 40 to be rotated more stably.

As mentioned above, this invention can effectively eliminate the drawback that the outer tube of the conventional ceiling fan is likely to vibrate and swing bias when the motor is operated; therefore, the fixing cables provided between the base and the fan blade holder of the conventional ceiling fan are needless to be employed in this invention, and hence the ceiling fan 100 of this invention is able to maintain the pretty external appearance of the ceiling fan 100.

While the preferred embodiment of the invention has been described above, it will be recognized and understood that various modifications may be made therein and the appended claims are intended to cover all such modifications that may fall within the spirit and scope of the invention.

What is claimed is:

1. A ceiling fan comprising an outer rotor motor, said outer rotor motor provided with a stator, said stator connected with a fixed shaft and having a circumference annularly disposed with a rotor, said rotor able to rotate around said stator that acts as a center shaft, said ceiling fan further comprising a rotating disc, said rotating disc connected to said rotor, said rotating disc bored with an insert hole at a location corresponding with said fixed shaft, said ceiling fan provided with an inner tube, said inner tube having one end inserted through said insert hole and secured with said fixed shaft, said ceiling fan further provided with an outer tube, said outer tube fitted around an outer side of said inner tube, said outer tube having one end connected with said rotating disc, and characterized by:

said rotating disc provided with a plurality of elastic buffer pieces spaced apart around said insert hole, and a combination space formed between every adjacent two elastic buffer pieces; and said outer tube having one end, which is to be connected with said rotating disc, set thereon with plural combination blocks protruding outward at locations corresponding with said combination space, said combination blocks respectively combined with corresponding said combination spaces.

2. The ceiling fan as claimed in claim 1, wherein said rotating disc is mounted thereon with a plurality of bulging blocks spaced apart around said insert hole, and said elastic buffer pieces are respectively secured on said bulging blocks.

3. The ceiling fan as claimed in claim 2, wherein each said bulging block is bored with a first through hole, and each said elastic buffer piece is bored with a second through hole corresponding to said first through hole, a bolt inserted and locked in both said first through hole and said second through hole for fixing said elastic buffer piece on said bulging block.

4. The ceiling fan as claimed in claim 1, wherein each said elastic buffer piece has one side, corresponding to said combination space, formed into a slant face to make said combination space formed into an inverted trapezoid shape, while said combination block, which corresponds to said combination space, formed into a trapezoid shape.

5. The ceiling fan as claimed in claim 1, wherein each said elastic buffer piece is disposed with a plurality of V-shaped recesses at one side corresponding with said combination space.

6. The ceiling fan as claimed in claim 1, wherein said outer tube is formed with a tubular body having one end connected with a connecting ring provided thereon with said combination blocks and another end connected with a fan blade holder.

7. The ceiling fan as claimed in claim 1, wherein each said elastic buffer piece is a rubber sleeve.

8. The ceiling fan as claimed in claim 1, wherein a plurality of bearings are provided between said inner tube and said outer tube, and each said bearing has an outer circumference fitted with a rubber bushing.

* * * * *